US010370811B2

(12) United States Patent
May

(10) Patent No.: US 10,370,811 B2
(45) Date of Patent: Aug. 6, 2019

(54) SNOW WING ASSEMBLY

(71) Applicant: Caterpillar Inc., Peoria, IL (US)

(72) Inventor: Michael P. May, Wamego, KS (US)

(73) Assignee: Caterpillar Inc., Deerfield, IL (US)

( * ) Notice: Subject to any disclaimer, the term of this patent is extended or adjusted under 35 U.S.C. 154(b) by 313 days.

(21) Appl. No.: 15/249,618

(22) Filed: Aug. 29, 2016

(65) Prior Publication Data

US 2016/0362858 A1 Dec. 15, 2016

(51) Int. Cl.
*E01H 5/06* (2006.01)

(52) U.S. Cl.
CPC ..... *E01H 5/067* (2013.01); *E01H 5/061* (2013.01); *E01H 5/062* (2013.01)

(58) Field of Classification Search
CPC ..... E01H 5/067
See application file for complete search history.

(56) References Cited

U.S. PATENT DOCUMENTS 2,332,712 A 10/1943 Gustafson et al.
3,241,254 A * 3/1966 Ulrich ..... E01H 5/067 172/782
3,659,363 A 5/1972 Snyder
4,045,892 A 9/1977 Farrell
4,356,645 A * 11/1982 Hine ..... E01H 5/06 172/815
5,177,887 A * 1/1993 McGugan ..... E01H 5/067 37/234
5,596,823 A 1/1997 Clasen et al.
6,041,673 A * 3/2000 Schmillen ..... B60K 26/04 74/481
6,249,992 B1 * 6/2001 Irving ..... E01H 5/067 172/786
6,389,345 B2 * 5/2002 Phelps ..... E02F 3/845 172/2
6,412,200 B1 * 7/2002 Savard ..... E01H 5/063 37/232
6,581,307 B1 * 6/2003 Jones ..... E01H 5/067 37/274

(Continued)

FOREIGN PATENT DOCUMENTS

CA 2932848 6/2015
CA 2887953 10/2015

*Primary Examiner* — Jelani A Smith
*Assistant Examiner* — Donald J Wallace
(74) *Attorney, Agent, or Firm* — Hibshman Claim Construction PLLC

(57) ABSTRACT

A snow wing assembly for a machine is provided. The snow wing assembly includes a wing blade provided on a first side of the machine. The snow wing assembly also includes a first cylinder coupled to the wing blade. The snow wing assembly further includes a controller coupled to the first cylinder and an articulation determination device. The controller is configured to receive a signal indicative of an articulation of the machine towards a second side from the articulation determination device. The controller is configured to extend the first cylinder freely based on the received signal and an amount of articulation. The controller is also configured to receive a signal indicative of the articulation of the machine towards the first side from the second side from the articulation determination device. The controller is further configured to lock the first cylinder in an extended position based on the received signal.

8 Claims, 11 Drawing Sheets

(56) References Cited

U.S. PATENT DOCUMENTS

| | | | | |
|---|---|---|---|---|
| 6,877,258 | B2 * | 4/2005 | Frey | E01H 5/06 37/274 |
| 9,303,377 | B2 * | 4/2016 | May | E01H 5/061 |
| 2005/0252045 | A1 * | 11/2005 | Savard | E02F 3/7659 37/281 |
| 2007/0193074 | A1 * | 8/2007 | Savard | E01H 5/067 37/274 |
| 2007/0250236 | A1 * | 10/2007 | Newberry | B60K 23/04 701/51 |
| 2009/0056961 | A1 * | 3/2009 | Gharsalli | E02F 3/844 172/4.5 |
| 2012/0160526 | A1 * | 6/2012 | Padilla | E02F 3/764 172/4.5 |
| 2012/0246977 | A1 * | 10/2012 | Proeber | E02F 3/841 37/197 |
| 2013/0227863 | A1 * | 9/2013 | Stephan | E01H 5/065 37/232 |
| 2014/0174063 | A1 * | 6/2014 | Gabibulayev | E02F 9/2296 60/327 |
| 2014/0336883 | A1 * | 11/2014 | Thompson | B60P 1/045 701/50 |
| 2014/0373496 | A1 * | 12/2014 | Schott | A01D 34/008 56/10.2 E |
| 2015/0066298 | A1 * | 3/2015 | Sharma | B62D 9/00 701/41 |
| 2015/0253151 | A1 * | 9/2015 | Inberg | E02F 9/2033 702/33 |
| 2017/0247855 | A1 * | 8/2017 | May | E02F 3/8157 |

* cited by examiner

SNOW WING ASSEMBLY

TECHNICAL FIELD

The present disclosure relates to a snow wing assembly. More particularly, the present disclosure relates to the snow wing assembly mounted on an articulating machine.

BACKGROUND

Machines, such as a motor grader, a wheel loader, and so on, include a frame having a front portion and a rear portion. The front portion is pivotally connected to the rear portion in order to provide articulation to the frame and in turn steering of the machine on ground.

During snow removal operation from a road surface or a paved surface, a wing blade is mounted on the machine, typically on a right side thereof. The wing blade is connected to both the front portion and the rear portion of the frame via a snow wing assembly. The wing blade in association with a center blade of the machine is used for plowing the snow from the road surface and further pushing the plowed snow towards a side of the road surface and/or in a ditch provided along the road surface.

During the snow removal operation, the wing blade may be held in a working position or a plowing position closer to the road surface. As such, in the plowing position, the machine may freely articulate both in a right direction as well as a left direction. However, when the wing blade may be held in a transport position or a stowed position, the wing blade and/or the snow wing assembly may cause hindrance and limit the articulation of the machine in the left direction mainly due to limited movement between components of the snow wing assembly.

U.S. Pat. No. 5,596,823 describes a hydraulic system having a double acting hydraulic cylinder for suitably supporting a snow wing on an articulated motor grader in a fixed roading position. The hydraulic system is provided with a pressure relief circuit that permits the motor grader to be articulated without manual adjustment of the hydraulic pressure in the hydraulic cylinder.

SUMMARY OF THE DISCLOSURE

In an aspect of the present disclosure, a snow wing assembly for a machine is provided. The machine includes a frame having a first portion and a second portion movably coupled to the first portion. The snow wing assembly includes a first bracket coupled to the first portion. The snow wing assembly includes a second bracket coupled to the second portion. The snow wing assembly includes a wing blade provided on a first side of the machine. The wing blade includes a first end and a second end. The first end is movably coupled to the first bracket. The snow wing assembly also includes a first cylinder movably coupled between the second bracket and the second end of the wing blade. The snow wing assembly further includes a controller coupled to the first cylinder and an articulation determination device associated with the machine. The controller is configured to receive a signal indicative of an articulation of the machine towards a second side from the articulation determination device. The controller is configured to extend the first cylinder freely based on the received signal and an amount of articulation. The controller is also configured to receive a signal indicative of the articulation of the machine towards the first side from the second side from the articulation determination device. The controller is further configured to lock the first cylinder in an extended position based on the received signal.

Other features and aspects of this disclosure will be apparent from the following description and the accompanying drawings.

DETAILED DESCRIPTION

Figure 1:
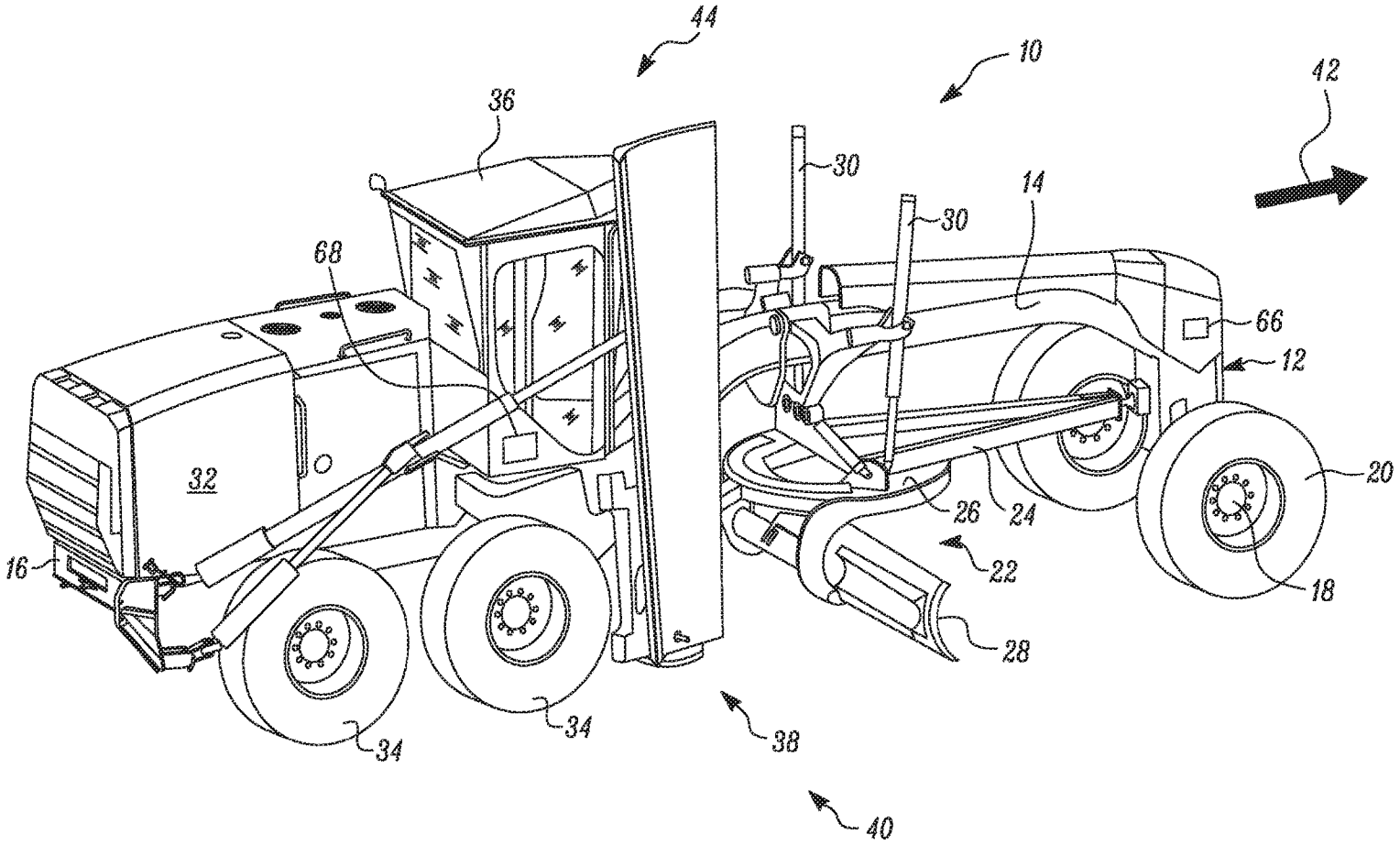
FIG. 1 is a perspective side view of an exemplary machine with a snow wing assembly mounted thereon, according to one embodiment of the present disclosure.

Wherever possible, the same reference numbers will be used throughout the drawings to refer to the same or the like parts. Referring to FIG. 1, an exemplary machine 10 is illustrated. More specifically, the machine 10 is a motor grader. The machine 10 is adapted to flatten uneven ground surface such as during grading process prior to road construction, moving of snow, debris, and so on. In other embodiments, the machine 10 may be any other machine having an articulating frame, such as a wheel loader (not shown), employed in an industry including, but not limited to, construction, agriculture, waste management, material handling, and forestry.

The machine 10 includes a frame 12. The frame defines a longitudinal axis X-X' (shown in FIG. 2) thereof. The frame 12 includes a first portion 14 and a second portion 16. The first portion 14 supports a steerable front axle 18. The front axle 18 supports front wheels 20 and provides steering to the machine 10 on the ground. The first portion 14 also supports a blade assembly 22 of the machine 10. More specifically, the blade assembly 22 is supported by using a drawbar 24 and a circle 26 coupled to the first portion 14.

The blade assembly 22 includes a center blade 28 coupled to the circle 26. The blade assembly 22 also includes one or more hydraulic cylinders 30 to support the center blade 28. One end of the hydraulic cylinders 30 is coupled to the first portion 14. Another end of the hydraulic cylinders 30 is coupled to the circle 26. The hydraulic cylinders 30 alter a distance and/or an angle of the center blade 28 with respect to the ground. The machine 10 also includes the second portion 16 movably coupled to the first portion 14. More specifically, the second portion 16 is movably coupled to the first portion 14 in order to provide articulation of the first portion 14 with respect to the second portion 16 of the frame 12.

The second portion 16 includes an enclosure 32 provided thereon. The enclosure 32 houses a power source (not shown). The power source may be any power source known in the art such as an internal combustion engine, a battery, a motor, and so on or a combination thereof. The machine 10 includes a set of rear wheels 34 coupled to the second portion 16. The rear wheels 34 support and provide mobility to the machine 10 on the ground. The machine 10 includes an operator cabin 36 provided on the second portion 16. The operator cabin 36 includes various controls (not shown) such as a steering, a joystick, an operator console, an operator seat, levers, pedals, buttons, switches, knobs, and so on. The controls are adapted to control the machine 10 on the ground.

Additionally, the machine 10 includes a snow wing assembly 38 mounted on frame 12. The snow wing assembly 38 is mounted on a first side 40 of the frame 12. In the illustrated embodiment, the first side 40 refers to a right side of the machine 10 based on a direction 42 of forward travel of the machine 10. In other embodiments, the snow wing assembly 38 may be alternatively mounted on a second side 44 of the machine 10. In the illustrated embodiment, the second side 44 refers to a left side of the machine 10 based on the direction 42 of forward travel of the machine 10.

Figure 2:
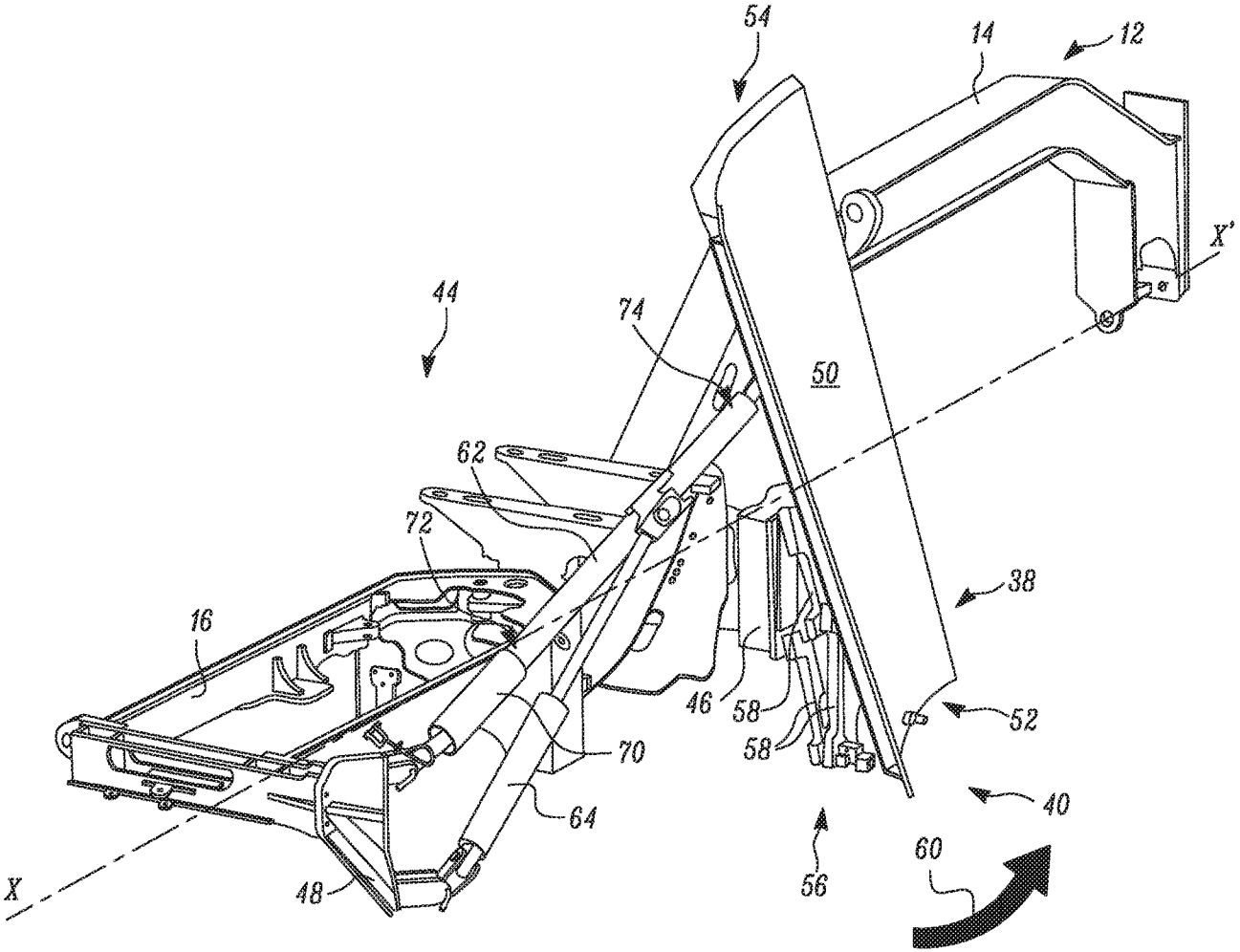
FIG. 2 is a perspective view of the snow wing assembly mounted on a frame of the machine of FIG. 1, according to one embodiment of the present disclosure.
Figure 9:
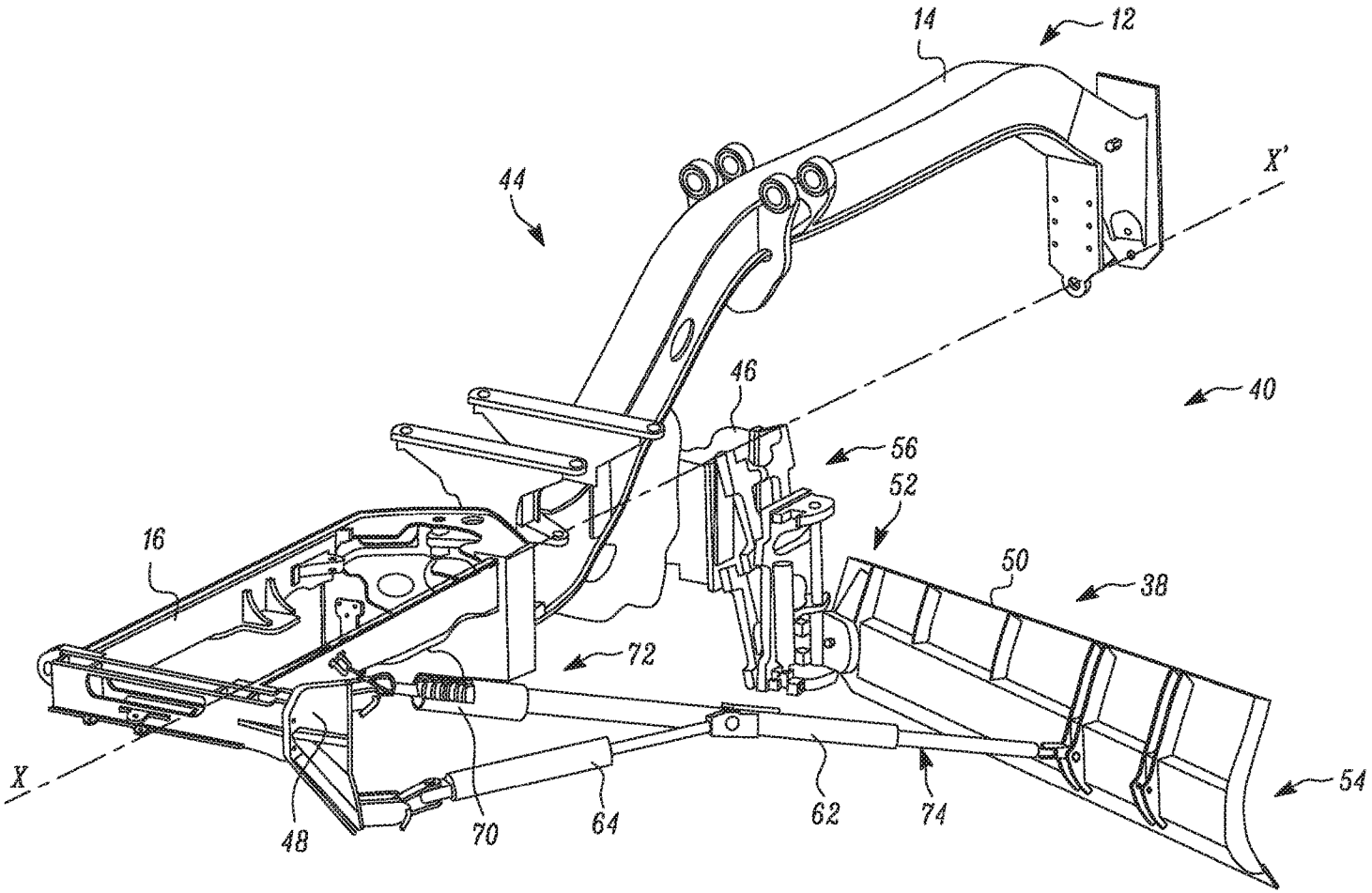
FIG. 9 is a perspective view of the frame and the snow wing assembly with a wing blade in a working position, according to one embodiment of the present disclosure.
Figure 10:
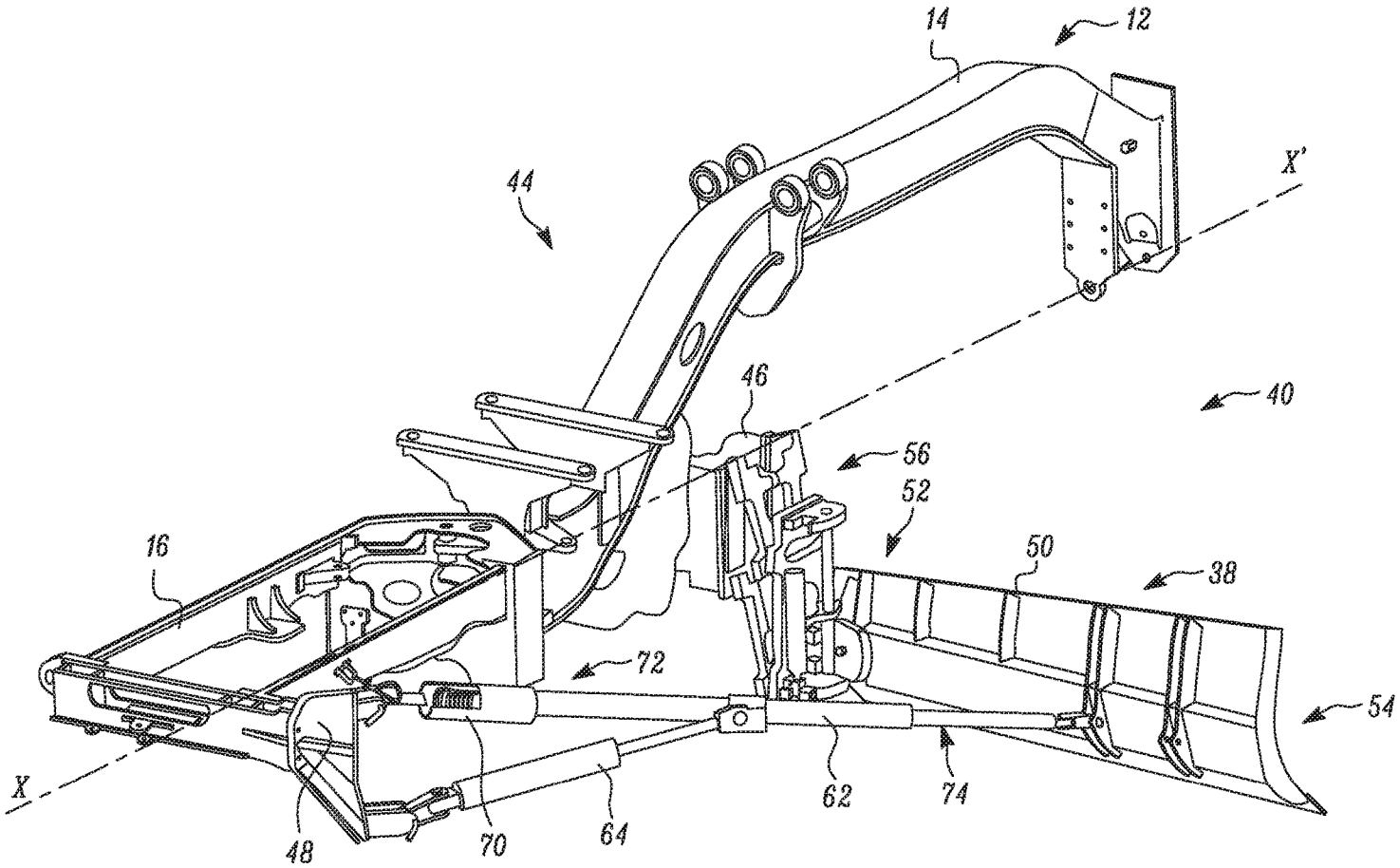
FIG. 10 is a perspective view of the frame and the snow wing assembly with the wing blade in another working position, according to one embodiment of the present disclosure.

Referring to FIG. 2, the snow wing assembly 38 includes a first bracket 46 coupled to the first portion 14 of the frame 12. The snow wing assembly 38 also includes a second bracket 48 coupled to the second portion 16 of the frame 12. The first bracket 46 and the second bracket 48 mount the snow wing assembly 38 to the first portion 14 and the second portion 16 of the frame 12 respectively. The snow wing assembly 38 also includes a wing blade 50 provided on the first side 40 of the machine 10. The wing blade 50 is movable between a stowed position (as shown in FIG. 2) and a working position (as shown in FIGS. 9 and 10).

The wing blade 50 includes an elongated configuration. The wing blade 50 includes a first end 52 and a second end 54. The first end 52 is movably coupled to the first bracket 46. In the illustrated embodiment, the snow wing assembly 38 includes a linkage assembly 56 in order to movably couple the first end 52 to the first bracket 46. It should be noted that in other embodiments, the first end 52 may be movably coupled to the first bracket 46 by any other method including, but not limited to, a hydraulic/pneumatic cylinder, a movable link, and an articulating joint, without limiting the scope of the disclosure.

The linkage assembly 56 alters a distance between the first end 52 and the first bracket 46 based on a position of the linkage assembly 56. More specifically, the linkage assembly 56 includes a number of bars 58 movably interconnected with one another. Based on a position of each of the bar 58 with respect to one another, the linkage assembly 56 expands and collapses with respect to the first bracket 46. Accordingly, the linkage assembly 56 moves the first end 52 of the wing blade 50 in a direction 60.

For example, as the linkage assembly 56 may expand, the distance between the first end 52 and the first bracket 46 or the first portion 14 of the frame 12 may increase. Simultaneously, a height of the first end 52 with respect to the first bracket 46 or the ground may increase. Similarly, as the linkage assembly 56 may collapse, the distance between the first end 52 and the first bracket 46 or the first portion 14 of the frame 12 may decrease. Simultaneously, the height of the first end 52 with respect to the first bracket 46 or the ground may decrease.

The snow wing assembly 38 includes a first cylinder 62 movably coupled between the second bracket 48 and the second end 54 of the wing blade 50. The first cylinder 62 alters a distance between the second end 54 and the second portion 16 of the frame 12. More specifically, as shown in FIGS. 9 and 10, as the first cylinder 62 may expand, the distance between the second end 54 and the second portion 16 of the frame 12 may increase in turn moving the second end 54 away with respect to the second portion 16 of the frame 12.

Also, as the first cylinder 62 may retract, the distance between the second end 54 and the second portion 16 of the frame 12 may decrease in turn moving the second end 54 closer with respect to the second portion 16 of the frame 12. It should be noted that based on a position of the first cylinder 62, the second end 54 of the wing blade 50 may be positioned at any location around the second bracket 48 present within a range of the first cylinder 62.

Referring to FIG. 2, the snow wing assembly 38 also includes a second cylinder 64 coupled between the second bracket 48 and the first cylinder 62. The second cylinder 64 alters the angle of the wing blade 50 with respect to the ground line while maintaining a radial distance between the second end 54 of the wing blade 50 and the second bracket 48. More specifically, as the second cylinder 64 may expand, a height of the second end 54 with respect to the second portion 16 of the frame 12 may increase in turn moving the second end 54 away with respect to the ground.

Also, as shown in FIGS. 9 and 10, as the second cylinder 64 may retract, the height of the second end 54 with respect to the second portion 16 of the frame 12 may increase in turn moving the second end 54 farther away with respect to the ground. It should be noted that based on a position of the second cylinder 64, the second end 54 of the wing blade 50 may be positioned at any location around the second bracket 48 present within a range of the second cylinder 64.

Figure 3:
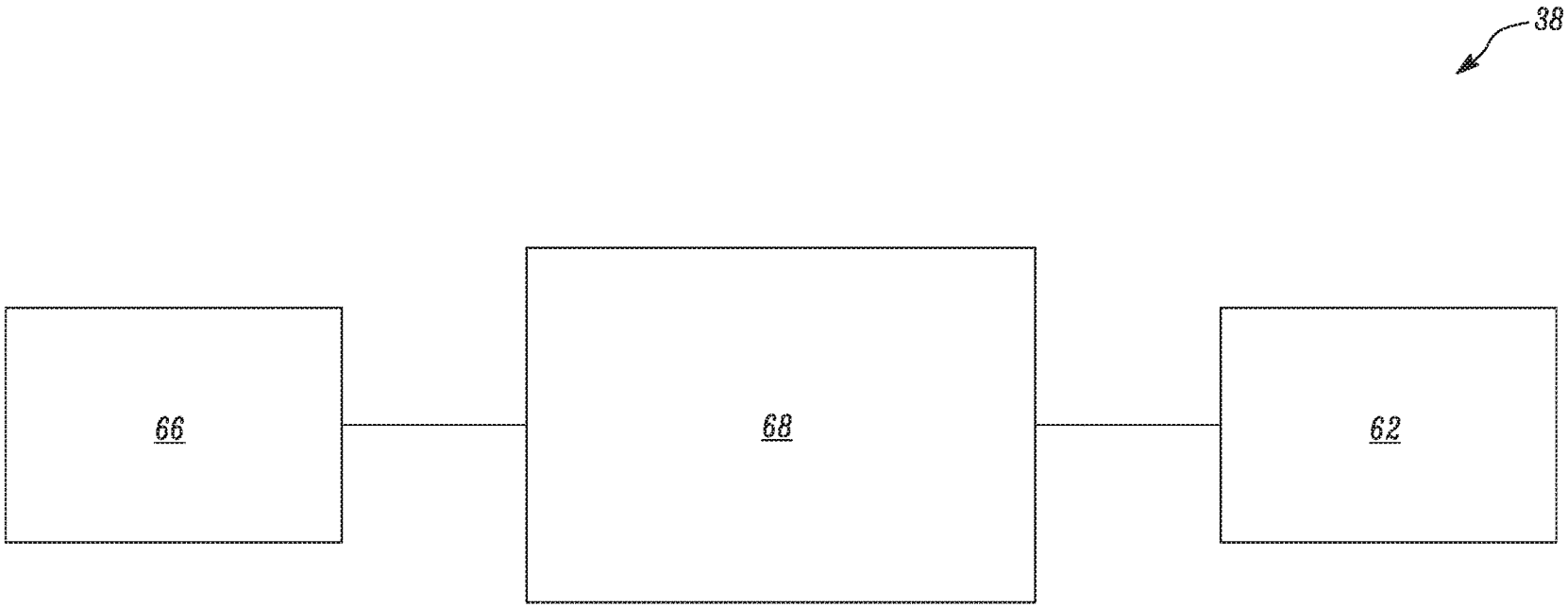
FIG. 3 is a schematic representation of the snow wing assembly, according to one embodiment of the present disclosure.

Referring to FIG. 3, the machine 10 also includes an articulation determination device 66 provided thereon. The articulation determination device 66 is provided in association with the first portion 14. In other embodiments, the articulation determination device 66 may be provided in association with the second portion 16 of the frame 12. The articulation determination device 66 may be any device known in the art including, but not limited to, an accelerometer, a magnetometer, a gyroscope sensor, and a steering position sensor. The articulation determination device 66 is configured to generate a signal indicative of an amount of articulation of the first portion 14 with respect to the second portion 16 of the frame 12.

Figure 4:
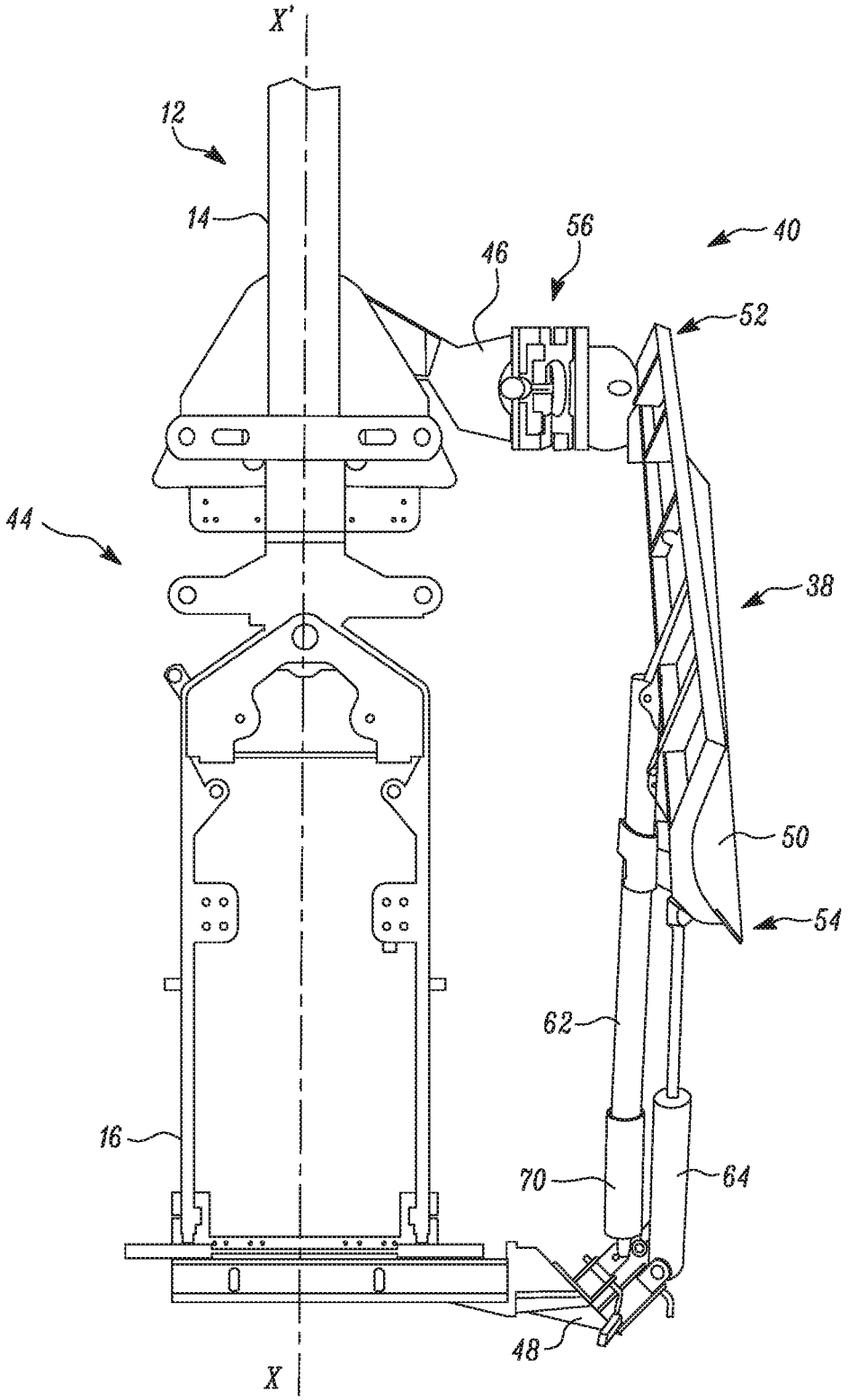
FIG. 4 is a top view of the frame and the snow wing assembly in a stowed position, according to one embodiment of the present disclosure.
Figure 5:
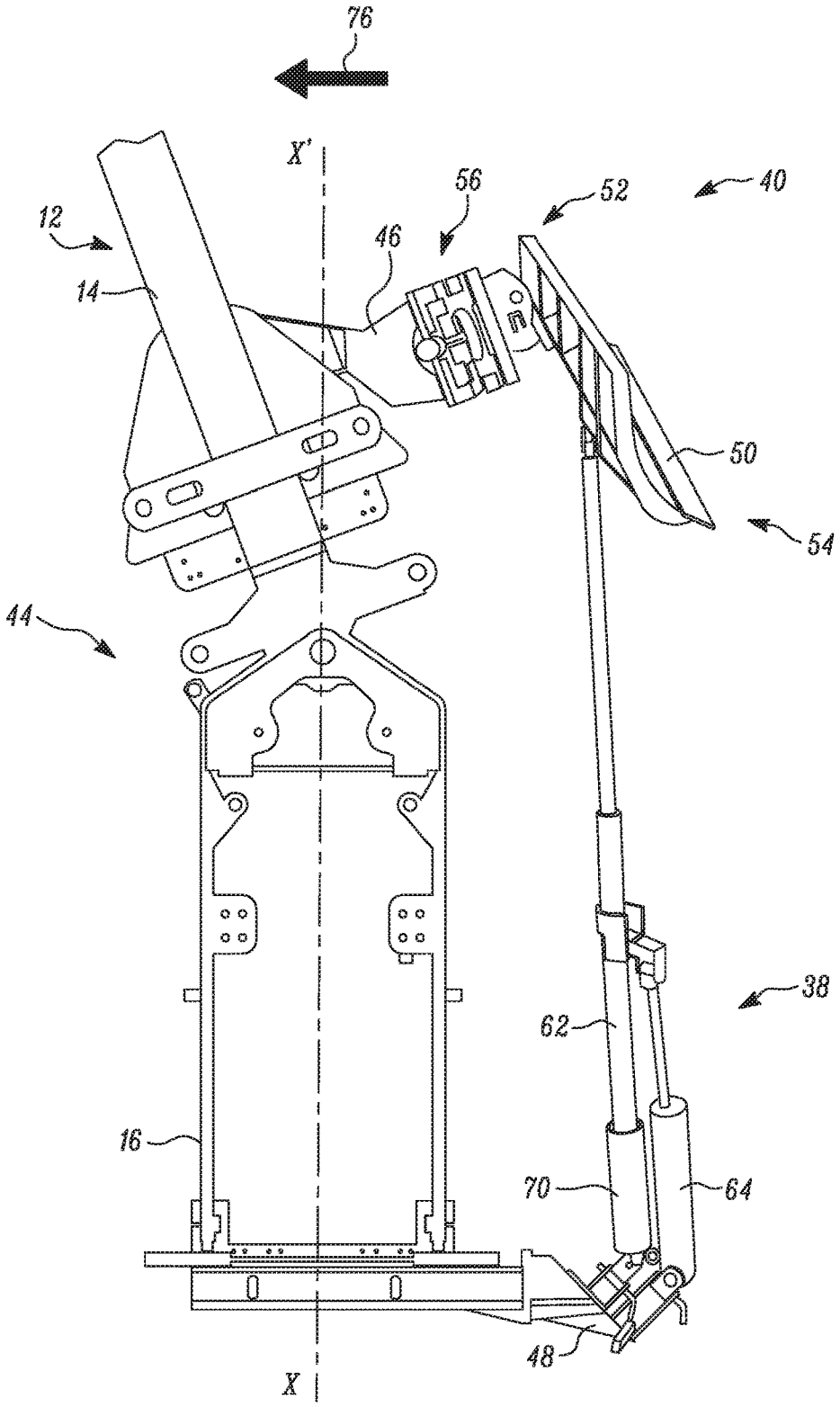
FIG. 5 is a top view of the snow wing assembly with the frame in an articulated position, according to one embodiment of the present disclosure.
Figure 6:
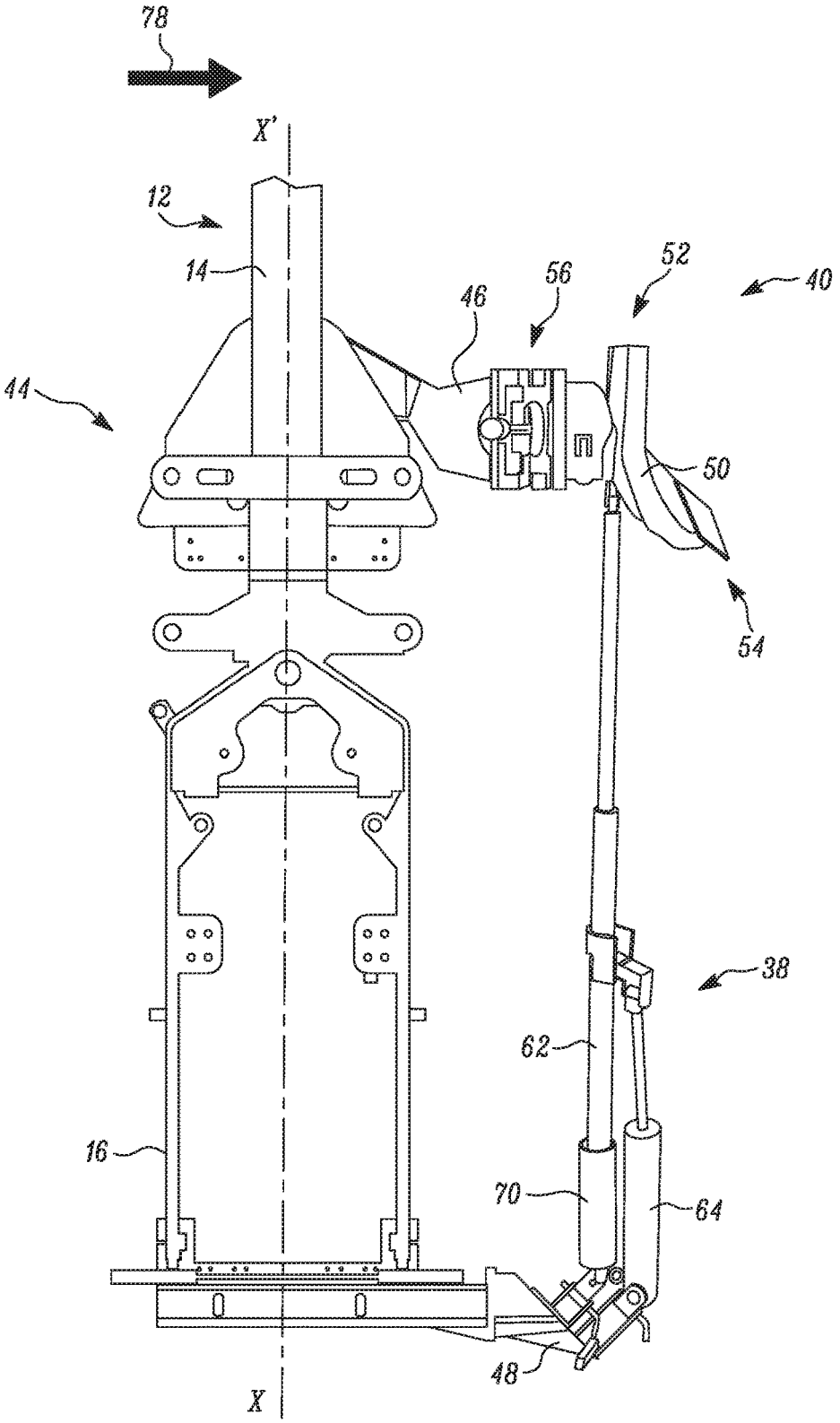
FIG. 6 is a top view of the snow wing assembly with the frame at a center position, according to one embodiment of the present disclosure.
Figure 7:
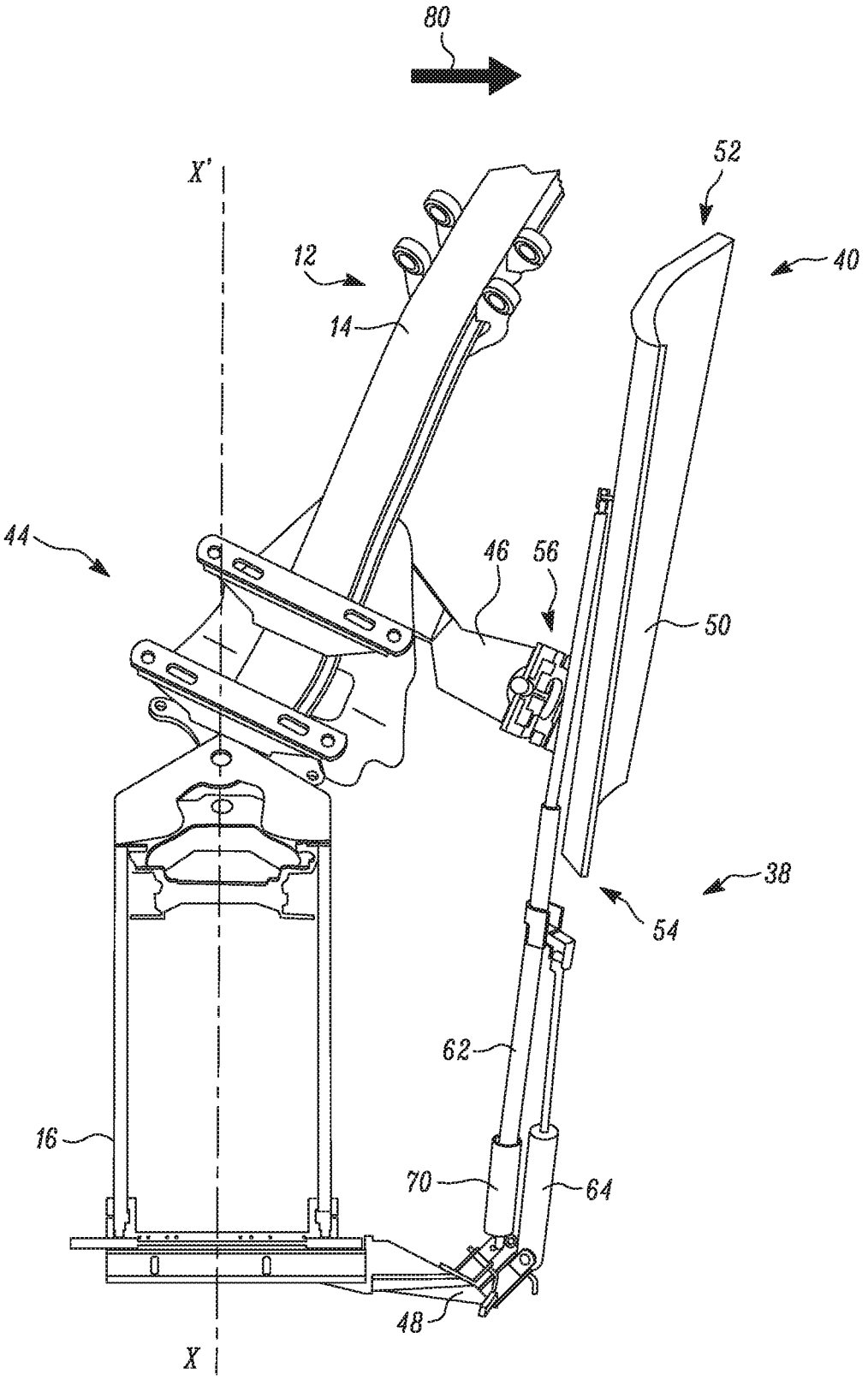
FIG. 7 is a top view of the snow wing assembly with the frame in another articulated position, according to one embodiment of the present disclosure.
Figure 8:
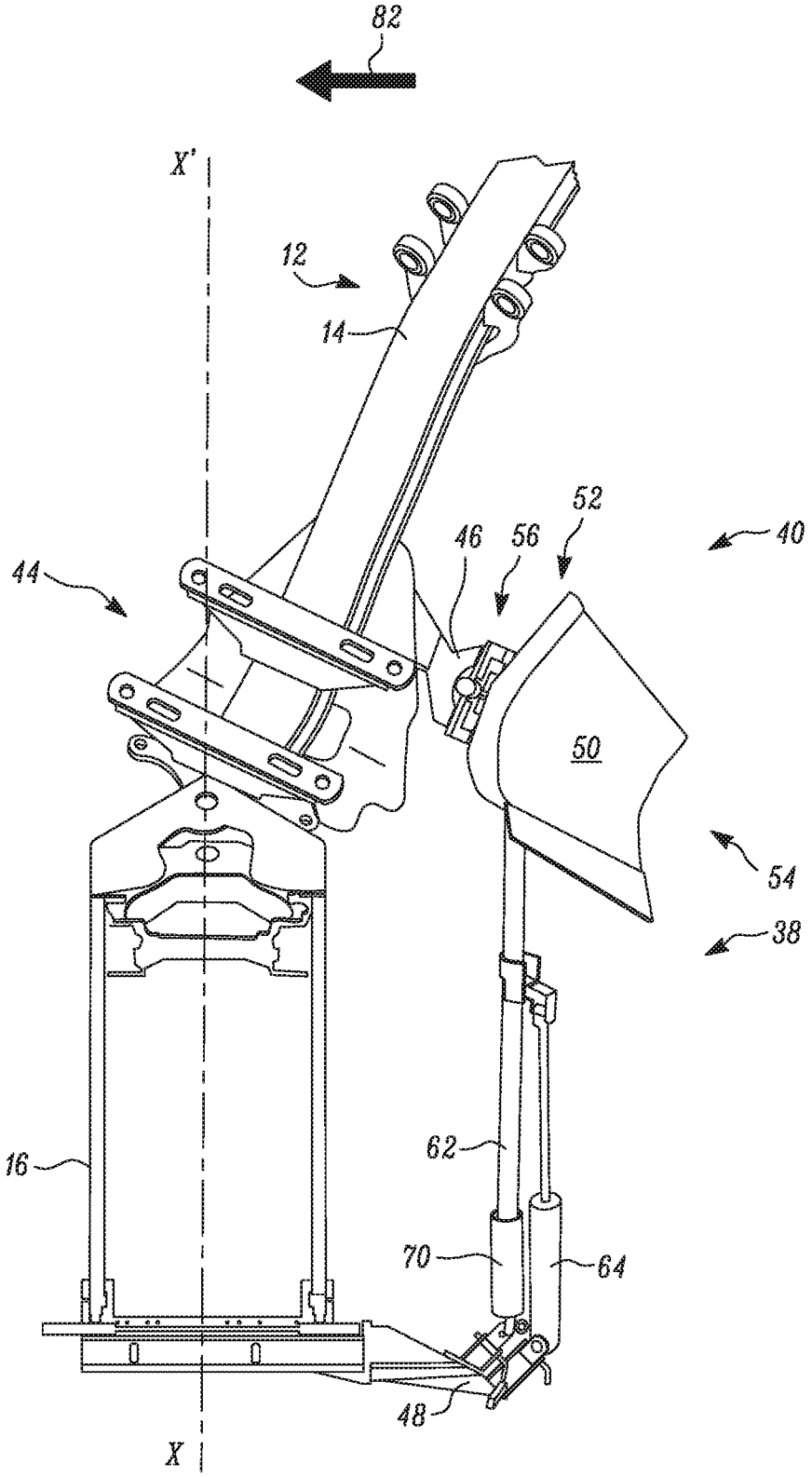
FIG. 8 is another top view of the snow wing assembly with the frame in the articulated position of FIG. 7, according to one embodiment of the present disclosure.

For example, as shown in FIG. 5, as the first portion 14 of the frame 12 articulates towards the second side 44 with respect to the second portion 16 and/or the longitudinal axis X-X', the articulation determination device 66 generates the signal indicative of the amount of articulation of the first portion 14 towards the second side 44. Also, as shown in FIGS. 7 and 8, as the first portion 14 of the frame 12 articulates towards the first side 40 with respect to the second portion 16 and/or the longitudinal axis X-X', the articulation determination device 66 generates the signal indicative of the amount of articulation of the first portion 14 towards the first side 40. Further, as shown in FIGS. 4 and 6, as the first portion 14 of the frame 12 is aligned at a center position with respect to the second portion 16 along the longitudinal axis X-X', the articulation determination device 66 generates the signal indicative of zero articulation of the first portion 14 with respect to the second portion 16.

Referring to FIGS. 2 and 3, the snow wing assembly 38 further includes a controller 68. The controller 68 is communicably coupled to the first cylinder 62 and the articulation determination device 66. Accordingly, the controller 68 is configured to receive the signal indicative of the articulation of the machine 10 towards the second side 44 from the articulation determination device 66. Based on the received signal and the amount of articulation, the controller 68 is configured to freely extend the first cylinder 62. Accordingly, the wing blade 50 is moved to an intermediate position from the stowed position.

Further, the controller 68 is configured to receive the signal indicative of the articulation of the machine 10 towards the first side 40 from the second side 44 from the articulation determination device 66. Based on the received signal, the controller 68 is configured to lock the first cylinder 62 in an extended position. The extended position refers to a position of the first cylinder 62 when the first cylinder 62 is freely extended based on the amount of articulation of the machine 10 towards the second side 44. More specifically, the extended position of the first cylinder 62 refers to the position of the first cylinder 62 when the wing blade is moved to the intermediate position.

Accordingly, the snow wing assembly 38 includes a valve (not shown) provided in association with the first cylinder 62. The valve may be any valve known in the art such as a check valve, a one way valve, a relief valve, and so on, or a combination thereof. In a first position of the valve, the first cylinder 62 is allowed to extend freely based on the amount of articulation of the machine 10 towards the second side 44. In a second position of the valve, the first cylinder 62 is locked in the extended position and prevented from retracting based on the articulation of the machine 10 towards the first side 40 from the second side 44.

Also, the controller 68 is configured to receive a signal indicative of the articulation of the machine 10 towards the second side 44 from the first side 40 from the articulation determination device 66. The controller 68 is further configured to determine the articulated position of the machine 10 towards the first side 40. Based on the received signal and the determination, the controller 68 is configured to retract the first cylinder 62 in order to move the wing blade 50 to the stowed position from the intermediate position.

In another embodiment, the controller 68 is configured to receive a signal indicative of stowing the wing blade 50 from an operator. The operator may provide a command indicative of stowing the wing blade 50 through one or more controls provided within the operator cabin 36. The controller 68 is further configured to determine the articulated position of the machine 10 towards at least one of the first side 40 and the center position. Based on the received signal and the determination, the controller 68 is configured to retract the first cylinder 62 in order to move the wing blade 50 to the stowed position from the intermediate position.

Referring to FIG. 2, the snow wing assembly 38 also includes a shock absorbing device 70 provided in association with the first cylinder 62. In the illustrated embodiment, the shock absorbing device 70 is a spring loaded canister. In other embodiments, the shock absorbing device 70 may be any other shock absorbing device such as a hydraulic/pneumatic cylinder, and so on.

Also, in the illustrated embodiment, the shock absorbing device 70 is provided between the second bracket 48 and a cylinder end 72 of the first cylinder 62. In other embodiments, the shock absorbing device 70 may be provided at any other location with respect to the first cylinder 62 such as between the second end 54 of the wing blade 50 and a rod end 74 of the first cylinder 62. The shock absorbing device 70 absorbs physical impacts received by the wing blade 50 due to contact with an obstacle (not shown) and will be explained in more detail later.

INDUSTRIAL APPLICABILITY

Figure 11:
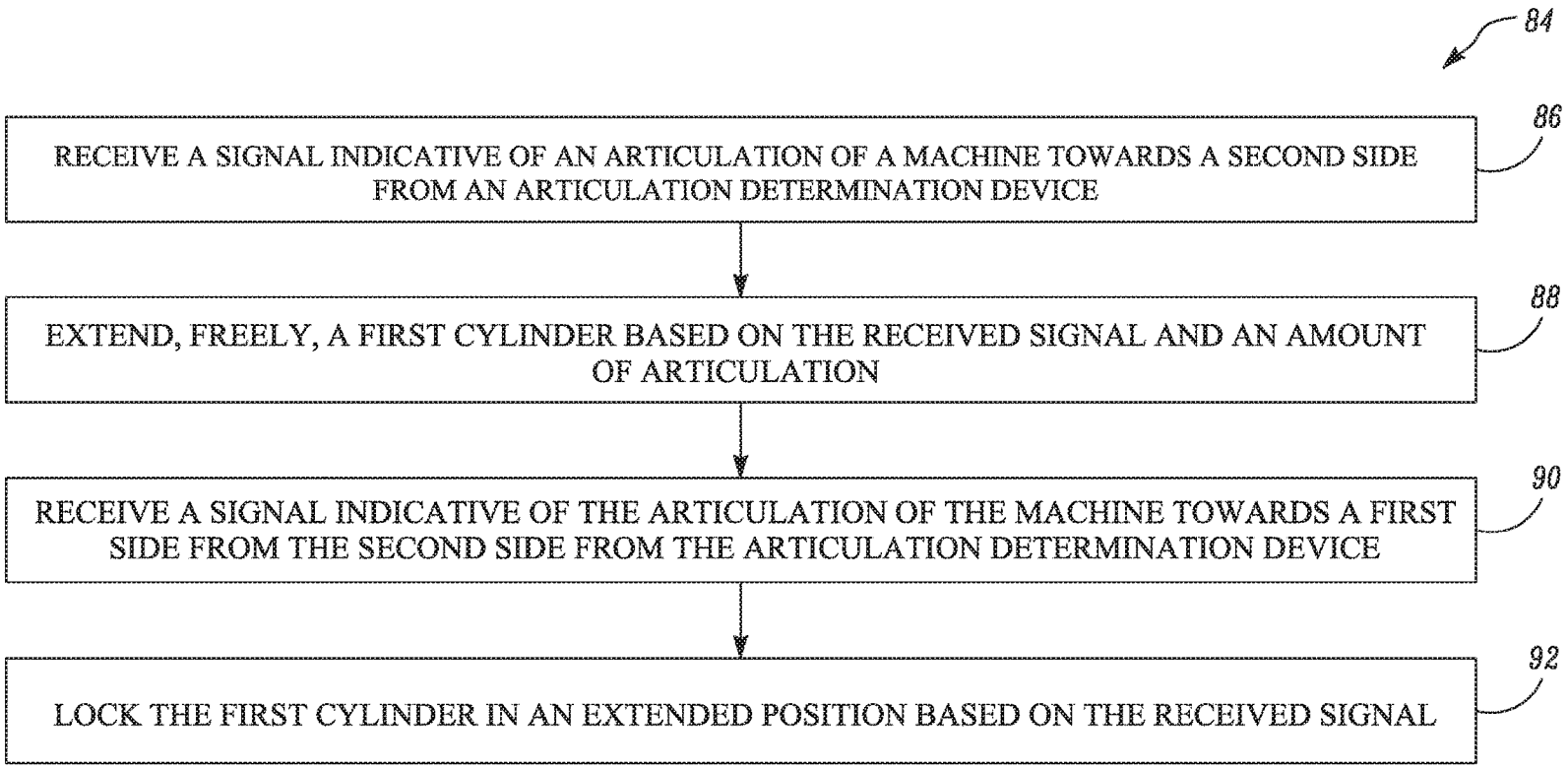
FIG. 11 is a flowchart illustrating a method of working of the snow wing assembly.

The present disclosure relates to the snow wing assembly 38. Referring to FIG. 11, a method 84 of the working of the snow wing assembly 38 is illustrated. Initially, as shown in FIG. 4, the first portion 14 is at the center position with respect to the second portion 16 of the frame 12. More specifically, the first portion 14 is aligned along the longitudinal axis X-X' with respect to the second portion 16 of the frame 12. Also, the wing blade 50 is in the stowed position. It should be noted that the method 84 may be applicable in any other position of the wing blade 50 such as the working position and/or any intermediate position between the stowed position and the working position, without limiting the scope of the disclosure.

At step 86, the controller 68 receives the signal indicative of the articulation of the machine 10 towards the second side 44 from the articulation determination device 66. More specifically, as shown in FIG. 5, the first portion 14 of the frame 12 articulates towards the second side 44 along a direction 76. In such a situation, the controller 68 receives the signal, generated by the articulation determination device 66, indicative of the articulation of the first portion 14 towards the second side 44 from the center position with respect to the second portion 16.

Accordingly, at step 88, the controller 68 allows free extension of the first cylinder 62 as the first portion 14 articulates towards the second side 44 from the center position. More specifically, as shown in FIG. 5, as the first portion 14 articulates along the direction 76, the first cylinder 62 extends freely in a manner such that the wing blade 50 moves from the stowed position to an intermediate position. The amount of extension of the cylinder is based on the amount of articulation of the first portion 14 with respect to the second portion 16. The extension of the first cylinder 62 allows accommodating the articulation of the machine 10 towards the second side 44 without putting the snow wing linkage in a bind. In such a situation, the valve is moved to a first position in order to allow free extension of the first cylinder 62.

At step 90, the controller 68 receives a signal indicative of the articulation of the machine 10 towards the first side 40 from the second side 44 from the articulation determination device 66. More specifically, as shown in FIG. 6, the first portion 14 of the frame 12 articulates towards the center position along a direction 78. In such a situation, the controller 68 receives the signal, generated by the articulation determination device 66, indicative of the articulation of the first portion 14 towards the center position from the second side 44 with respect to the second portion 16.

Accordingly, at step 92, the controller 68 locks the first cylinder 62 in the extended position based on the received signal. In such a situation, the valve is moved to a second position in order to prohibit extension or retraction of the first cylinder 62. Similarly, as shown in FIG. 7, as the first portion 14 may further articulate towards the first side 40 from the center position along a direction 80, the first cylinder 62 continues to be locked in the extended position. The locking of the first cylinder 62 in the extended position limits movement of the wing blade 50 towards the longitudinal axis X-X' during the articulation of the first portion 14 towards the center position and/or the first side 40 with respect to the second portion 16 of the frame 12. As a result, interference of the wing blade 50 with the frame 12, the operator cabin 36, and/or any other portion of the machine 10 is eliminated according to the present embodiment.

In one embodiment, referring to FIG. 8, as the first portion 14 of the frame 12 articulates back towards the longitudinal axis X-X' and/or the second side 44 from the first side 40 along a direction 82, the controller 68 receives the signal indicative of the articulation of the machine 10 towards the first side 40 and/or the center position from the articulation determination device 66.

Further, the controller 68 determines the articulated position of the machine 10 towards the first side 40. More specifically, the controller 68 determines a current articulated position of the first portion 14 with respect to the second portion 16 of the frame 12 of the machine 10 from the articulation determination device 66. In a situation when the current articulated position of the first portion 14 is on the first side 40 with respect to the longitudinal axis X-X', the controller 68 retracts the first cylinder 62 in order to move the wing blade 50 from the intermediate position to the stowed position.

In another embodiment, the controller 68 receives the signal indicative of stowing the wing blade 50 from the operator. Based on the received signal, the controller 68 determines the articulated position of the machine 10 towards at least one of the first side 40 and the center position. More specifically, the controller 68 determines the current articulated position of the first portion 14 with respect to the second portion 16 of the frame 12 of the machine 10 from the articulation determination device 66. In the situation when the current articulated position of the first portion 14 is on the first side 40 or the center position with respect to the longitudinal axis X-X', the controller 68 retracts the first cylinder 62 in order to move the wing blade 50 from the intermediate position to the stowed position.

The snow wing assembly 38 also includes a shock absorbing device 70. As shown in FIG. 9, when the wing blade 50 may encounter an obstacle, the shock absorbing device 70 may retract. The retraction of the shock absorbing device 70 provides freedom of movement to the wing blade 50 along with absorption of physical impact received by the wing blade 50. Further, as shown in FIG. 10, when the wing blade 50 may pass the obstacle, the shock absorbing device 70 may return to the default or non-retracted position thereof, in turn, moving the wing blade 50 back to a previous working position. Accordingly, the shock absorbing device 70 provides to limit transfer of physical impacts from the wing blade 50 to the second portion 16 of the frame 12. As a result, damage to various components of the snow wing assembly 38 and/or the machine 10 is minimized.

The snow wing assembly 38 provides a simple and effective method to articulate the machine 10 towards the first side 40 or the second side 44 without causing binding in the snow wing assembly and machine components due to articulation of the machine when the wing blade 50 is in the stored or transport position. The system/method 84 described herein may be employed in any snow wing assembly 38 with minor modifications to the overall system.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A snow wing assembly for a machine, the machine including a frame having a first portion and a second portion movably coupled to the first portion, the snow wing assembly comprising:

a first bracket coupled to the first portion;

a second bracket coupled to the second portion;

a wing blade provided on a first side of the machine, the wing blade having a first end and a second end, the first end being movably coupled to the first bracket;

a first cylinder movably coupled between the second bracket and the second end of the wing blade; and a controller coupled to the first cylinder and an articulation determination device associated with the machine, the controller being configured to:

receive a first signal indicative of a first articulation of the machine toward a second side of the machine from the articulation determination device;

release the first cylinder to move freely based on the first signal and an amount of the first articulation;

receive a second signal indicative of a second articulation of the machine toward the first side from the second side from the articulation determination device; and lock the first cylinder in an extended position based on the second signal.

2. The snow wing assembly of claim 1, wherein the controller is further configured to:

receive a third signal indicative of a third articulation of the machine toward the second side from the first side from the articulation determination device;

determine an articulated position of the machine toward the first side; and retract the first cylinder based on the third signal and the articulated position of the machine.

3. The snow wing assembly of claim 1, wherein the controller is further configured to:

receive a third signal indicative of stowing the wing blade;

determine an articulated position of the machine toward at least one of the first side and a center position; and retract the first cylinder based on the third signal and the articulated position of the machine.

4. The snow wing assembly of claim 1, further comprising a second cylinder coupled between the second bracket and the first cylinder, the second cylinder being adapted to alter an angle of the wing blade with respect to a ground line while maintaining a radial distance between the second end of the wing blade and the second bracket.

5. The snow wing assembly of claim 1, further comprising a linkage assembly coupled between the first bracket and the first end of the wing blade, the linkage assembly being adapted to alter a distance between the first end of the wing blade and the first bracket.

6. The snow wing assembly of claim 1, further comprising a shock absorbing device provided in association with the first cylinder.

7. The snow wing assembly of claim 1, further comprising a valve associated with the first cylinder, the valve being adapted to lock the first cylinder.

8. The snow wing assembly of claim 1, wherein the articulation determination device includes at least one of an accelerometer, a magnetometer, a gyroscope sensor, and a steering position sensor.

* * * * *